US006004715A

United States Patent [19]

Suzuki et al.

[11] Patent Number: 6,004,715

[45] **Date of Patent: *Dec. 21, 1999**

[54] TONER FOR DEVELOPING ELECTROSTATIC IMAGES

[75] Inventors: Masanori Suzuki; Hachiroh Tosaka; Mituo Aoki; Hiroyuki Fushimi; Akihiro Kotsugai, all of Shizuoka-ken, Japan

[73] Assignee: Ricoh Company, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/670,067

[22] Filed: Jun. 25, 1996

[30] Foreign Application Priority Data

Jun. 26, 1995 [JP] Japan ..... 7-182117

[51] Int. Cl.[6] ..... G03G 9/08

[52] U.S. Cl. ..... 430/111; 430/137

[58] Field of Search ..... 430/111, 137

[56] References Cited

U.S. PATENT DOCUMENTS

| | | | |
|---|---|---|---|
| 4,762,763 | 8/1988 | Nomura et al. | 430/110 |
| 4,973,541 | 11/1990 | Kohri et al. | 430/111 |
| 4,987,454 | 1/1991 | Natsuhara et al. | 355/259 |
| 5,004,665 | 4/1991 | Ohtani et al. | 430/106.6 |
| 5,079,125 | 1/1992 | Anno et al. | 430/111 |
| 5,204,205 | 4/1993 | Anno et al. | 430/109 |
| 5,510,222 | 4/1996 | Inaba et al. | 430/109 |
| 5,512,406 | 4/1996 | Takeda et al. | 430/110 |
| 5,659,857 | 8/1997 | Yamazaki et al. | 399/252 |

*Primary Examiner*—Nam Nguyen
*Assistant Examiner*—Steven H. VerSteeg
*Attorney, Agent, or Firm*—Oblon, Spivak, McClelland, Maier & Neustadt, P.C.

[57] ABSTRACT

A toner for developing an electrostatic latent image, which includes ground toner particles having physical properties meeting with at least one of the following conditions (a) and (b):

(a) the toner particles have an average surface roughness of at least 0.89, the average suface roughness being an average of SF1 of respective toner particles, where SF1 is defined as follows:

$$SF1=Le/Lp$$

wherein Le and Lp represent the length of the minimum envelope line and the peripheral length of each toner particle, respectively;

(b) the toner particles have an average shape index SF3 of at least 0.63, the average shape index being a product of the average of SF1 and an average of SF2, where SF1 is as defined above and SF2 is defined as follows:

$$SF2=4S/(P^2\times\pi)$$

wherein S and P represent the area and the maximum diameter of each toner particle, respectively.

15 Claims, 1 Drawing Sheet

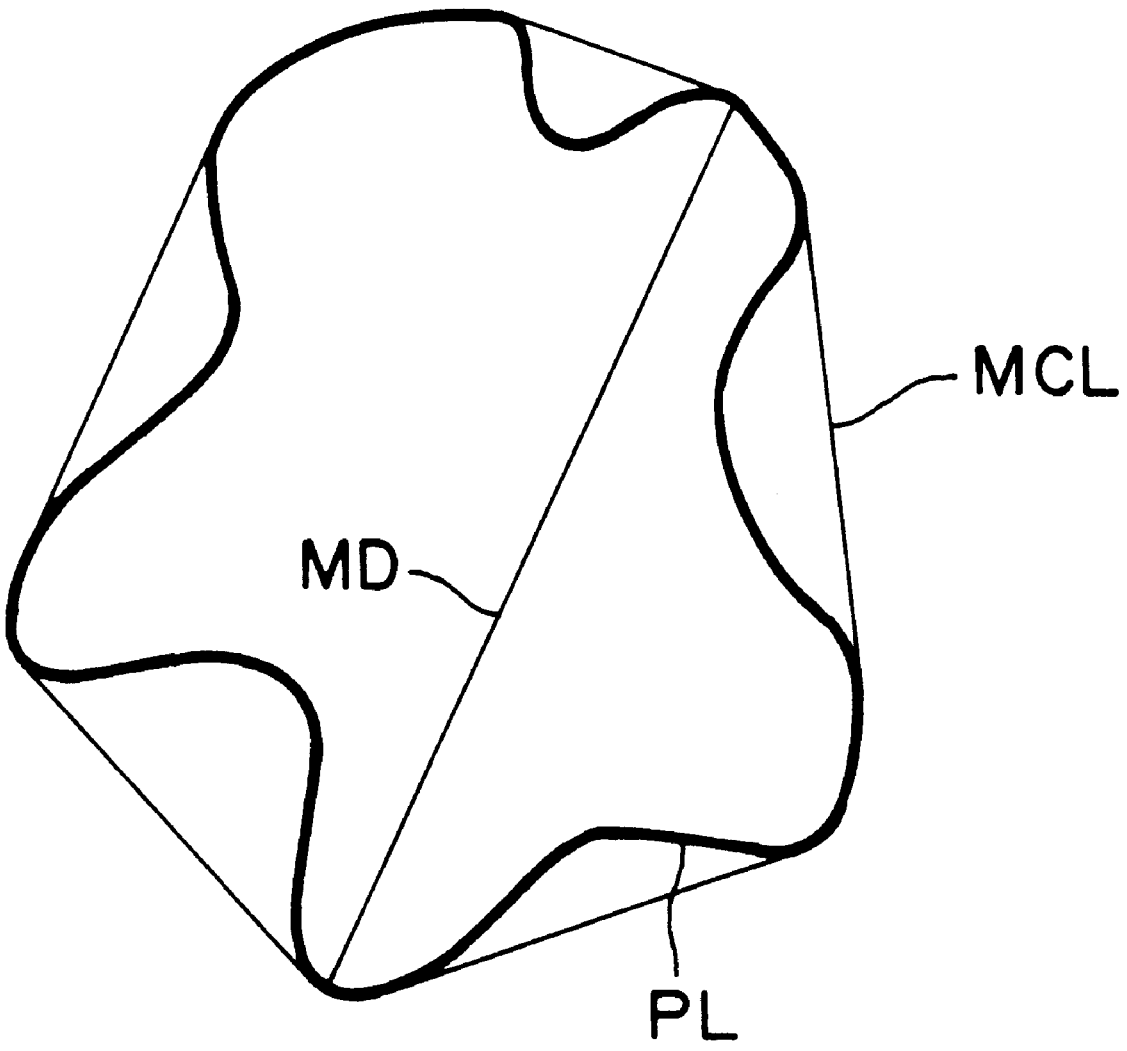
MCL
MD
PL

TONER FOR DEVELOPING ELECTROSTATIC IMAGES

BACKGROUND OF THE INVENTION

This invention relates to a toner for developing electrostatic images in an image forming method such as electrophotography, electrostatic printing or electrostatic recording.

In a dry copying method, an electrostatic latent image on a photosensitive medium is developed with a toner composed of a binder and a coloring agent. The developed toner image is transferred to a transfer member such as paper and fixed there.

Toner is generally produced by a grinding method or a polymerization method. In the former method, a blend of a binder, a coloring agent and other optional additives is kneaded at a temperature higher than the softening point of the binder. The kneaded product is then solidified, crushed, pulverized and sieved to have a desired particle size distribution, thereby obtaining a toner (hereinafter referred to ground toner). In the latter, polymerization method, a raw material monomer is polymerized in the presence of a coloring agent and any other optional additives to form fine toner beads. Thus, the toner of the latter type is not subjected to grinding or pulverization.

Known ground toner has a problem because part of the toner image on a photosensitive medium remains untransferred in the image transferring step. Thus, it is a general practice to remove such residual toner in a cleaning step. In view of the recent demand for light weight, compact-sized copying machines, however, it is desired that the cleaning be performed with a simple mechanism. Hence, there is a strong demand for a toner which ensures the efficient image transfer. The provision of such a toner with a high image transfer efficiency is essential in the case of an image forming apparatus in which the image transfer is effected by bringing an image transfer medium into pressure contact with an image-bearing photosensitive medium while applying a bias voltage thereto, since the toner image when pressed to the photosensitive member is more tightly held thereto as compared with a case where no pressure is applied to the toner image.

The toner obtained by the polymerization method has a serious problem because the content of the coloring agent cannot be increased to a desired level. In addition, residual toner remaining on a photosensitive medium after the image transfer is difficult to be removed in the succeeding cleaning step.

SUMMARY OF THE INVENTION

It is, therefore, a prime object of the present invention to provide a ground toner for developing electrostatic images which exhibits excellent image transfer efficiency and which gives high fidelity images even after repeated continuous copying operations.

Another object of the present invention is to provide a toner suitably used together with a carrier as a two-components developer.

In accomplishing the above object, there is provided in accordance with the present invention a toner for developing an electrostatic latent image, comprising ground toner particles having physical properties meeting with at least one of the following conditions (a) and (b):

(a) said toner particles have an average surface roughness of at least 0.89, said average surface roughness being an average of SF1 of respective toner particles, where SF1 is defined as follows:

$$SF1=Le/Lp$$

wherein Le and Lp represent the length of the minimum envelope line and the peripheral length of each toner particle, respectively, and (b) said toner particles have an average shape index SF3 of at least 0.63, said average shape index being a product of said average of SF1 and an average of SF2, where SF1 is as defined above and SF2 is defined as follows:

$$SF2=4S/(P^2\times\pi)$$

wherein S and P represent the area and the maximum diameter of each toner particle, respectively.

"MINIMUM ENVELOPE LINE", "PERIPHERAL LENGTH", "AREA" and "MAXIMUM DIAMETER" of toner particles are measured by a reflection-type scanning electron microscope (SEM).

These terms are defined as follows:

MINIMUM ENVELOPE LINE is the minimum length line surrounding the SEM pattern of a given particle. In the case of a particle shown in FIG. 1, for example, the minimum envelope line is as designated as MCL;

PERIPHERAL LENGTH is the length of the outer periphery of the SEM pattern. In the case of FIG. 1, the peripheral length is the length of the peripheral line PL;

AREA is an area of the SEM pattern. In the case of FIG. 1, the area is that of the portion defined by the peripheral line PL;

MAXIMUM DIAMETER is the maximum length of a line extending between two points on the peripheral line of the SEM pattern. In the case of FIG. 1, the maximum diameter is the length of a line MD.

It is important that the toner should meet with at least one of the above conditions (a) and (b) in order to obtain satisfactory image transfer efficiency and, in the case of two-components developer composed of a carrier and a toner, in order to prevent melt-adhesion of toner on the surfaces of carrier during repeated use.

It is preferred that the toner meet with both conditions (a) and (b) simultaneously. Preferably, the average of SF2 is at least 0.68. The upper limits of SF1, SF2 and SF3 are preferably 0.95, 0.95 and 0.90, respectively.

BRIEF DESCRIPTION OF THE DRAWINGS

Other objects, features and advantages of the present invention will become apparent from the detailed description of the preferred embodiments of the invention which follows, when considered in light of the accompanying drawing, in which the sole FIGURE is a schematic illustration of a SEM pattern of a toner particle.

DETAILED DESCRIPTION OF THE PREFERRED EMBODIMENTS OF THE INVENTION

The toner according to the present invention is formed of a binder and a coloring agent.

The binder resin may be, for example, a homopolymer of styrene or a styrene derivative such as polystyrene, poly(p-chlorostyrene) or poly(vinyltoluene); a styrene copolymer such as a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-octyl acrylate copolymer, a styrene-methyl methacrylate copolymer, a styrene-ethyl methacrylate copolymer, a styrene-butyl methacrylate copolymer, a styrene-methyl α-chloromethacrylate copolymer, a styrene-acrylonitrile copolymer, a styrene-vinyl methyl ketone copolymer, a styrene-butadiene copolymer, a styrene-isoprene copolymer, a styrene-acrylonitrile-indene terpolymer, a styrene-maleic acid copolymer or a styrene-maleate copolymer; poly(methyl methacrylate); poly(butyl methacrylate); poly(vinyl chloride); poly(vinyl acetate); polyethylene; polypropylene, polyester; polyurethane; polyamide; an epoxy resin; poly (vinyl butyral); poly(acrylic acid); rosin; modified rosin; a terpene resin; an aliphatic or alicyclic hydrocarbon resin; an aromatic petroleum resin; chlorinated paraffin; or paraffin wax. These resins may be used by themselves or as a mixture of two or more.

Illustrative of suitable binder resins for use in fixation under a pressure are polyolefins such as low molecular weight polyethylene (MW: 1,000–5,000), low molecular weight polypropylene (MW: 1,000–5,000), oxidized polyethylene and poly(4-fluoroethylene); epoxy resins; polyesters, styrene-butadiene copolymers (monomer ratio: (5–30):(95–70)); olefin copolymers such as ethylene-acrylic acid copolymers, ethylene-acrylate copolymers, ethylene-methacrylic acid copolymers, ethylene-methacrylate copolymers, ethylene-vinyl chloride copolymers, ethylene-vinyl acetate copolymers and ionomer resins); polyvinylpyrrolidones; methyl vinyl ether-maleic anhydride copolymers; maleic acid-modified phenol resins and phenol-modified terpene resins.

Any known colorant may be used for the purpose of the invention. The colorant may be, for example, carbon black, lamp black, iron black, ultramarine, a nigrosine dye, aniline blue, phthalocyanine blue, phthalocyanine green, hansa yellow G, rhodamine 6G, lake, chalco oil blue, chrome yellow, quinacridone, benzidine yellow, rose bengal, a triarylmethane dye and a monoazo or bisazo dye or pigment. These colorants may be used by themselves or in combination with two or more.

The toner preferably contains a customarily employed charge controlling agent. Illustrative of suitable positively charging agents are nigrosine, basic dyes, lake pigments of basic dyes and quaternary ammonium salts. Illustrative of suitable negatively charging agents are metal salts of monoazo dyes, salicylic acid, naphthoic acid and metal complexes of dicarboxylic acids.

The toner according to the present invention may contain one or more additives, if desired. Illustrative of additives are a lubricant such as tetrafluoroethylene or zinc stearate; an abrasive such as cerium oxide or silicon carbide; a flowability improving agent (caking-prevention agent) such as colloidal silica or aluminum oxide; an electrical conductivity-imparting agent such as carbon black or tin oxide; and fixation adjuvant such as a low molecular weight polyolefin.

The toner may be used as a magnetic toner. For this purpose, a magnetic material such as iron oxide (e.g. magnetite or hematite), metallic cobalt or nickel, an alloy of iron, cobalt and/or nickel with one or more metals such as aluminum, copper, lead, magnesium, tin, zinc, antimony, beryllium, bismuth, cadmium, calcium, manganese, selenium, titanium, tungsten and vanadium, is incorporated into the toner. The magnetic material preferably has an average particle diameter of 0.1–2 μm and preferably used in an amount of 20–200 parts by weight, more preferably 40–150 parts by weight, per 100 parts by weight of the binder resin of the toner.

The toner of the present invention is suitably used as a two-component-type developing system in conjunction with carrier particles which may be (a) magnetic particles such as metals, compounds and alloys of iron, cobalt and nickel, (b) glass beads or (c) composite particles composed of the above magnetic particles or glass beads each coated with a layer of a resin. Illustrative of suitable resin for forming the resin coating are styrene-acrylate copolymers preferably having a styrene content of 30–90% by weight, silicone resins, maleic acid resins, fluorine resins, polyester resins and epoxy resins. The resin coating may further contain one or more additives such as an adhesion improver, a curing agent, a lubricant, an electrically conductive agent and a charge controlling agent.

If desired, the ground toner according to the present invention may be used as a mixture with a toner obtained by a polymerization method.

The following examples will further illustrate the present invention. Parts are by weight.

Preparation of Carrier

| | |
|---|---|
| Silicone resin (KR250 manufactured by Shinetsu Silicone Inc.) | 100 parts |
| Carbon Black (#44 manufactured by Mitsubishi Chemical Industry Inc.) | 4 parts |
| Toluene | 100 parts |

The above composition was mixed with a mixer for 30 minutes to form a dispersion. The dispersion was charged into a fluidized bed-type coating device together with 1,000 parts of ferrite particles having an average particle diameter of 100 μm. The ferrite particles thus coated were dried to obtain Carrier A.

EXAMPLE 1–10 AND COMPARATIVE EXAMPLE 1

| | |
|---|---|
| Polyester resin (weight average molecular weight: 250,000) | 70 parts |
| Styrene-methyl methacrylate copolymer | 30 parts |
| wax (acid value: 15) | 4 parts |
| Carbon black (#44 manufactured by Mitsubishi Chemical Industry Inc.) | 8 parts |
| Quaternary ammonium salt | 1 part |

The above composition was thoroughly mixed with a Henschel mixer and then kneaded at a temperature of 130–140° C. for about 30 minutes with a roll mill. The kneaded mixture was cooled to room temperature and the solidified mass was ground with a jet-type grinding device in which the solidified mass was repeatedly allowed to collide against stationary collision plates by the action of jet of compressed air. The resulting ground mass was then further pulverized with a rotor-type grinding device having a rotor coaxially disposed within a stationary housing and sieved to obtain a toner having a particle diameter of 5–20 μm. By varying the residence time with the jet-type grinding device and the rotation speed of the rotor of the rotor-type grinding device, various toner products with different SF1, SF2 and SF3 were obtained.

The values of SF1, SF2 and SF3 of respective toner products were measured by SEM. Thus, 15 samples were arbitrarily selected at random for each toner product. SEM patterns of the 15 samples of each toner product were analyzed with an image analyzer (Ruzex IIIU manufactured by Nicore Co., Ltd.) to determine SF1 and SF2 thereof. The results are summarized in Table 1.

TABLE 1

| | Average SF1*1 | Average 5F2*2. | SF3 (SF1 × SF2) |
|---|---|---|---|
| Example No. | | | |
| 1 | 0.90 | 0.60 | 0.54 |
| 2 | 0.87 | 0.69 | 0.60 |
| 3 | 0.90 | 0.72 | 0.64 |
| 4 | 0.90 | 0.78 | 0.70 |
| 5 | 0.92 | 0.68 | 0.62 |
| 6 | 0.78 | 0.82 | 0.64 |
| 7 | 0.95 | 0.67 | 0.63 |
| 8 | 0.91 | 0.72 | 0.65 |
| 9 | 0.94 | 0.78 | 0.73 |
| 10 | 0.89 | 0.68 | 0.60 |
| Comparative Example | | | |
| 1 | 0.70 | 0.58 | 0.41 |

*1: Average of 15 samples
*2: Average of 15 samples

Each toner (2.5 parts) was mixed with 97.5 parts of the above Carrier A using a ball mill to obtain a developer. Each of the thus obtained developers was charged in a copying machine (FT-5500 manufactured by Ricoh Company, Ltd. and modified to install a cylindrical transfer roller in the image transferring section). The copying machine was continuously operated to obtain 150,000 copies. The toner images on the copies obtained at the first and final copying operations were checked with the naked eyes to evaluate the uniformity of a solid portion, reproducibility of a fine line portion, reproducibility of a dotted portion and freeness of image transfer failure in the central region of the copy.

The evaluation was made according to the following ratings:

A: excellent

B: good

C: fair

D: no good

E: worse

Further, the transfer efficiency was determined by the measurement of the weight of the toner on the photosensitive medium before and after the image transfer. The toner was collected on an adhesive tape. The transfer efficiency is calculated according to the following equation:

$$\text{Transfer Efficiency } (\%) = W_1/W_0 \times 100$$

wherein $W_1$ and $W_0$ represent the weight of the toner after image transfer and the weight of the toner before image transfer, respectively. The results are summarized in Table 2.

TABLE 2

| | Solid*1 | Line*2 | Dot*3 | Efficiency*4 | Freeness*5 |
|---|---|---|---|---|---|
| Example No. | | | | | |
| 1 | B | B | B | 89 | D |
| 2 | B | B | B | 90 | D |
| 3 | A | A | A | 93 | B |
| 4 | A | A | A | 95 | A |
| 5 | A | B | B | 90 | C |
| 6 | A | B | A | 89 | B |

TABLE 2-continued

| | Solid*1 | Line*2 | Dot*3 | Efficiency*4 | Freeness*5 |
|---|---|---|---|---|---|
| 7 | B | B | A | 91 | B |
| 8 | A | A | A | 94 | A |
| 9 | A | A | A | 96 | A |
| 10 | A | B | B | 90 | D |
| Comp. | | | | | |
| 1 | D | D | D | 75 | E |

*1: uniformity of a solid portion
*2: reproducibility of a fine line portion
*3: reproducibility of a dotted portion
*4: transfer efficiency
*5: absence of image transfer failure in the central region The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A toner for developing an electrostatic latent image, comprising solid ground toner particles having physical properties meeting both of the following conditions (a) and (b):

(a) said toner particles have an average surface roughness (SF1) of from 0.89 to 0.95, said average surface roughness being an average of SF1 of respective toner particles, wherein SF1 is defined as follows:

$$SF1 = Le/Lp$$

wherein Le and Lp represent the length of the minimum envelope line and the peripheral length of each toner particle, respectively; and (b) said toner particles have an average shape index (SF3) of from 0.63 to 0.90, said average shape index being a product of said average of SF1 and an average of SF2, where SF1 is as defined above and SF2 is defined as follows:

$$SF2 = 4s/(P^2 \times \pi)$$

wherein S and P represent the area and the maximum diameter of each toner particle, respectively.

2. The toner of claim 1, wherein said average of SF2 is from 0.68 to 0.95.

3. The toner of claim 1, which comprises one or more binders and one or more coloring agents.

4. The toner of claim 3, which further contains a charge controlling agent.

5. The toner of claim 4, wherein said charge controlling agent is a positive charging agent selected from the group consisting of nigrosine, basic dyes, lake pigments of basic dyes and quaternary ammonium salts.

6. The toner of claim 4, wherein said charge controlling agent is a negative charging agent selected from the group consisting of metal salts of monoazo dyes, salicylic acid, naphthoic acid and metal complexes of dicarboxylic acids.

7. The toner of claim 3, which further comprises an additive selected from the group consisting of lubricants, abrasives, flowability improving agents, electrical conductivity-imparting agents and fixation adjuvants.

8. The toner of claim 7, wherein said lubricant is tetrafluoroethylene or zinc stearate.

9. The toner of claim 7, wherein said abrasive is cerium oxide or silicon carbide.

10. The toner of claim 7, wherein said flowability improving agent is colloidal silica or aluminum oxide.

11. The toner of claim 7, wherein said electrical conductivity-imparting agent is carbon black or tin oxide.

12. The toner of claim 7, wherein said fixation adjuvant is a polyolefin.

13. The toner of claim 7, wherein SF1 has a value of from 0.90 to 0.94.

14. The toner of claim 7, wherein SF2 has a value of from 0.68 to 0.82.

15. The toner of claim 7, wherein SF3 has a value of from 0.63 to 0.73.

* * * * *